United States Patent [19]

Leichtfried et al.

[11] 4,333,667

[45] Jun. 8, 1982

[54] SKI BRAKE

[75] Inventors: Friedrich Leichtfried, Traiskirchen; Alois Himmetsberger, Vienna, both of Austria

[73] Assignee: TMC Corporation, Baar, Switzerland

[21] Appl. No.: 105,069

[22] Filed: Dec. 19, 1979

[30] Foreign Application Priority Data

Dec. 21, 1978 [AT] Austria ..... 9119/78
Feb. 5, 1979 [AT] Austria ..... 846/79

[51] Int. Cl.[3] ..... A63C 7/10
[52] U.S. Cl. ..... 280/605
[58] Field of Search ..... 280/605, 604

[56] References Cited

U.S. PATENT DOCUMENTS

| | | | |
|---|---|---|---|
| 3,715,126 | 2/1973 | Schwarz | 280/605 |
| 3,964,760 | 6/1976 | Riedel | 280/605 |
| 4,101,145 | 7/1978 | Korger | 280/605 |
| 4,123,083 | 10/1978 | Riedel | 280/605 |

FOREIGN PATENT DOCUMENTS

| | | | |
|---|---|---|---|
| 2326214 | 4/1977 | France | 280/605 |

*Primary Examiner*—Joseph F. Peters, Jr.

*Assistant Examiner*—Milton L. Smith

*Attorney, Agent, or Firm*—Blanchard, Flynn, Thiel, Boutell & Tanis

[57] ABSTRACT

A ski brake having a support plate secured to a ski and a combination of a support member and an operating plate pivotally secured to the support plate, which support member and operating plate pivotally support the brake arms therein for movement between a retracted position above the upper surface of a ski and a braking position wherein the brake arms extend beneath the lower surface of the ski. The pivotal movement of the support member and operating plate relative to the support plate, as well as the pivotal movement of the brake arms relative to the support member and the operating plate, is accomplished by a single spring. The vertical height of the operating plate above the support member is initially different so that when the ski boot urges the operating plate downwardly relative to the support member, the two surfaces will become flushed and the brake arms will be pivoted through the last range of movement to a position located above the upper surface of the ski and inwardly of the lateral edges thereof.

14 Claims, 23 Drawing Figures

SKI BRAKE

FIELD OF THE INVENTION

This invention relates to a ski brake and, more particularly, to a ski brake wherein the brake arms are permitted to move between positions above the upper surface of the ski and positions spaced laterally outwardly of the lateral edges of the ski, as well as from the braking position to the retracted position against the urging of a single spring.

BACKGROUND OF THE INVENTION

The ski brake which is described in U.S. application Ser. No. 6,389 now U.S. Pat. No. 4,268,060, issued May. 19, 1981, has great advantages compared with conventional ski brakes, particularly with respect to the simple and effective pivoting of the individual braking mandrels from the braking position into the retracted position and vice versa. This structure however, requires, aside from the spring which is needed for pivoting the entire braking mechanism, additional springs which load the individual braking mandrels. The goal of the present invention is to improve this known construction, particularly by having the pivoting of the entire braking mechanism and also the rotation of the individual braking mandrels occur against the force of one single spring.

Through the inventive measure disclosed herein, the approximately 90° rotation of each braking leg is achieved directly by stepping down on the pedal or by releasing the structural part to effect the rotation in the opposite direction of rotation. Further advantages are that the skier will have a secure feeling between the positions of swinging down of the braking mechanism and stepping down on the operating plate (in swung-down condition of the braking mechanism) relative to the support member, and that each braking leg is in the tilted position, namely lying above and within the upper side edges of the ski.

Both here and also in the following detailed description of the invention the collective term braking mechanism is to include such structural parts of the ski brake which are effective for changing their position during the braking and operating process.

A particularly preferable embodiment of the invention consists in the operating plate being able to be stepped down upon in the last stage of stepping down relative to the support member against the force of the erecting spring which pivots the entire ski brake, wherein the erecting spring has in the top view a substantially U-shaped design, the two free ends of which in its relaxed position define an angle $\alpha$ with the plane of the remaining parts of the erecting spring, which free ends in relaxed position extend at an acute angle $\beta$ with respect to one another, and wherein the erecting spring is arranged extending in direction of the longitudinal extent of the operating plate and is arranged resting at least with its two areas which have the individual ends on the underside of the stepping area of the operating plate and is arranged between said underside and the holding plate on the operating plate. This embodiment has the advantage that the use of one single spring is sufficient to pivot or rotate on the one hand the braking mechanism and on the other hand the two braking mandrels from the retracted position into the braking position.

A further inventive measure is that the support member and the operating plate are each constructed with a base form which is substantially rectangular, wherein the lateral edges of the support member are rolled in and downwardly toward the ski to form tubelike bearing structures, in which bearing structures is arranged a section of the braking leg acting as an axle part, wherein the inside diameter of the individual bearing structures have a clearance which permits substantially normally with respect to the longitudinal extent of the axle part of the braking leg a limited pivoting movement relative to the associated bearing end—is larger than the diameter of the axle part of the associated braking leg, and the lateral ends of the operating plate are bent pointing toward the ski and thus are constructed as a type of a hinge part, in which hinge parts a further section of the braking leg, which section acts as an operating part, is arranged, and the axle part and the operating part of the braking leg are connected through a bent section, which in turn is aligned extending at an angle of approximately 45° from the axle part in direction toward the longitudinal axis of the ski. This embodiment assures a particularly good support of the individual braking legs and a compact construction of the entire pedal.

A different, also inventively important measure, consists in the pedal being constructed as a support member which is approximately U-shaped in the top view, the two arms of which support member are provided for receiving a swivel block having a rectangular recess, wherein the individual braking legs are arranged or supported extending substantially parallel with respect to the longitudinal direction of the ski and extending both through slotted holes of the support member and also through the individual swivel blocks, and in each swivel block being connected through a hinge to the operating plate.

Due to the fact that the operating plate is connected hingelike to two swivel blocks, wherein in the individual swivel blocks there are supported the individual braking wings, which also extend through slotted holes in the support member, it is inventively achieved that one single spring does not only produce the erecting force which is needed for pivoting of the entire braking mechanism from the retracted position into the braking position, but also that rotation of the individual braking legs by means of pressing the operating plate down relative to the support member can occur against the force of this spring. In other words: when the ski boot which presses down the operating plate is removed, the spring first urges the two braking wings and thus the operating plate into the swung-out position which corresponds with the braking position and subsequently from the retracted swung-out position into the braking position. The slotted holes which are provided for guiding the individual braking legs in the support member and the longer axis of which extends substantially at a right angle with respect to the longitudinal axis of the ski, are thereby needed for compensating for the difference between the rotational movement of the individual hinge parts and the individual swivel blocks.

BRIEF DESCRIPTION OF THE DRAWINGS

Further advantages, details and characteristics of the invention will now be described in more detail with reference to the drawings, which illustrate two exemplary embodiments.

According to the first exemplary embodiment, the construction of the ski brake which forms the subject matter of the present invention is as follows.

Figure 11:
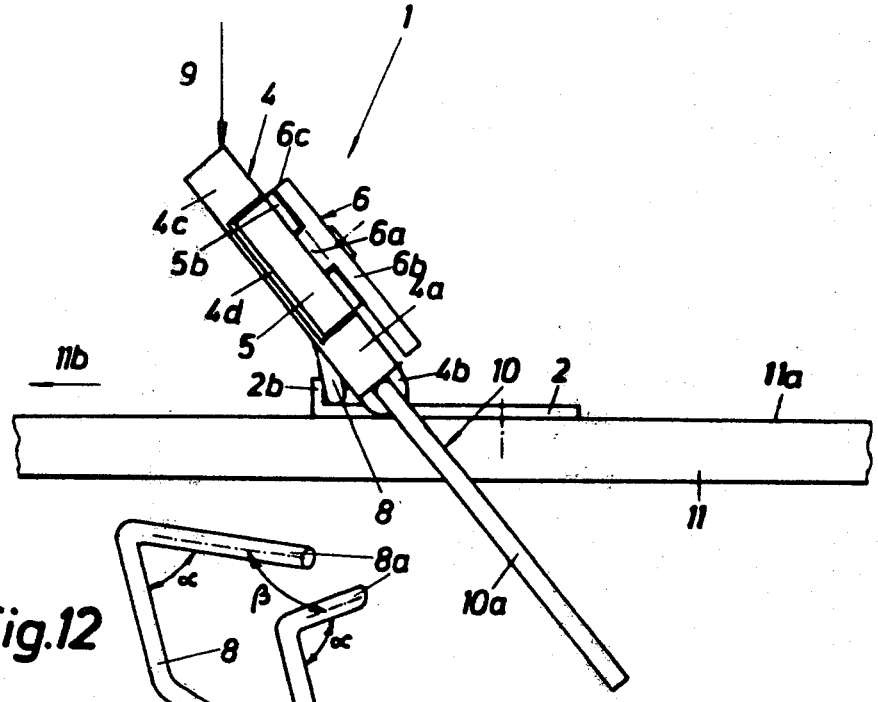
Figure 12:
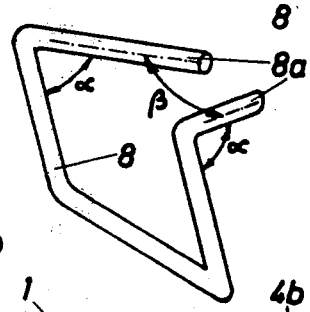
Figure 13:
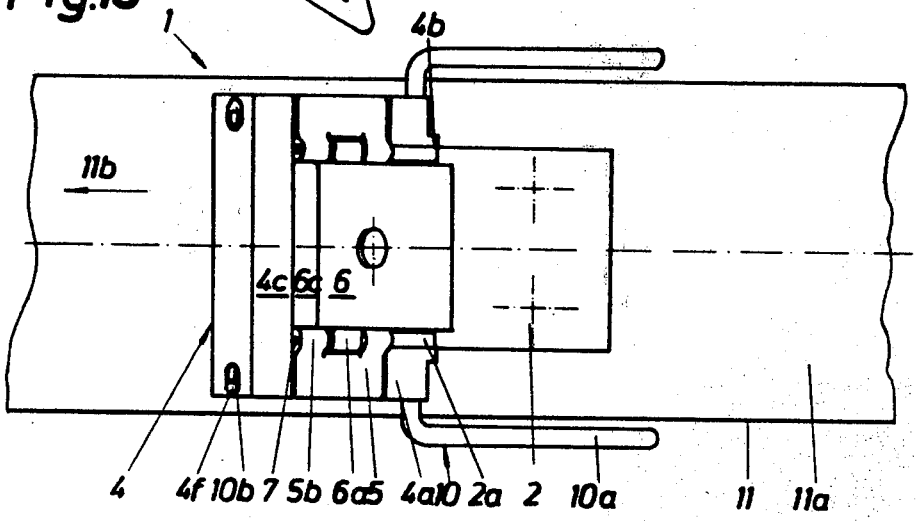
Figure 14:
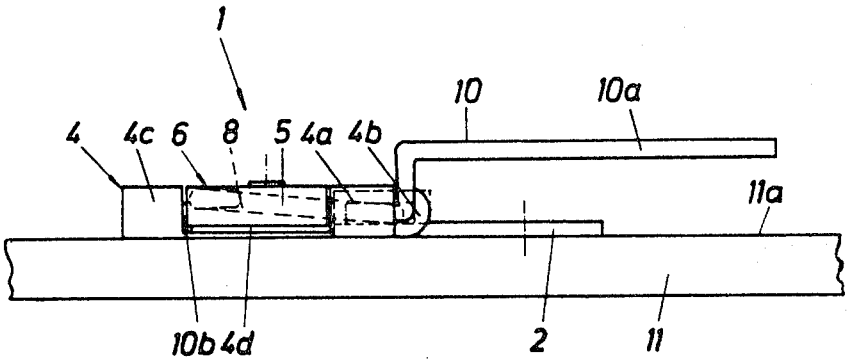
Figure 15:
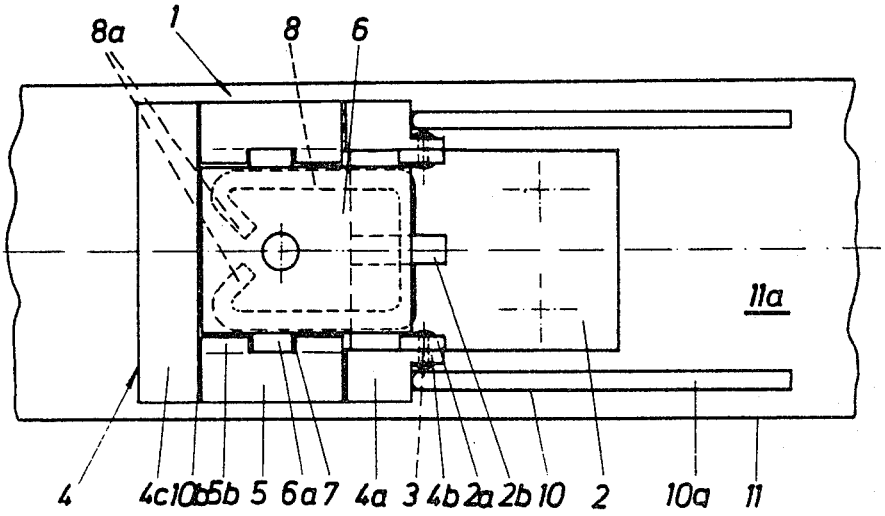
Figure 16:
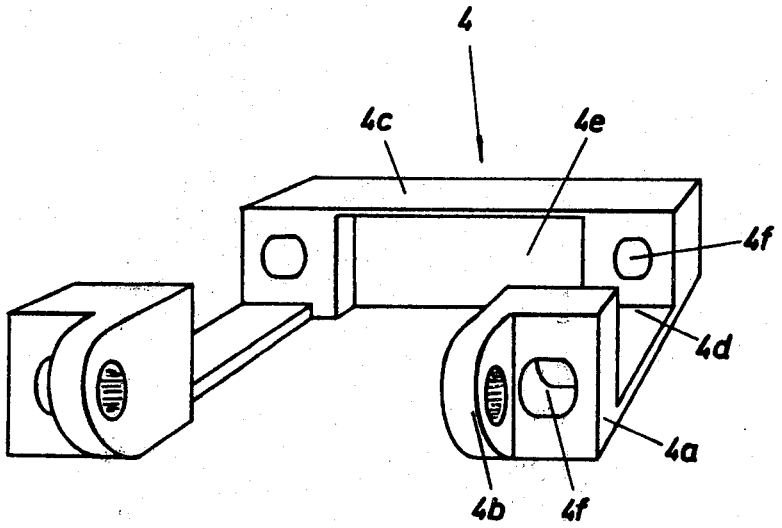
Figure 17:
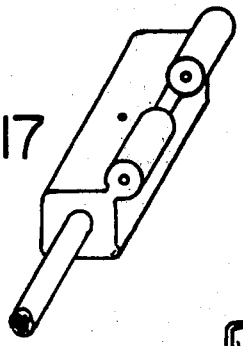
Figure 18:
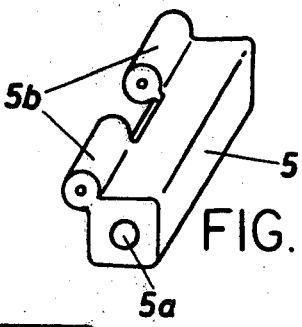
Figure 19:
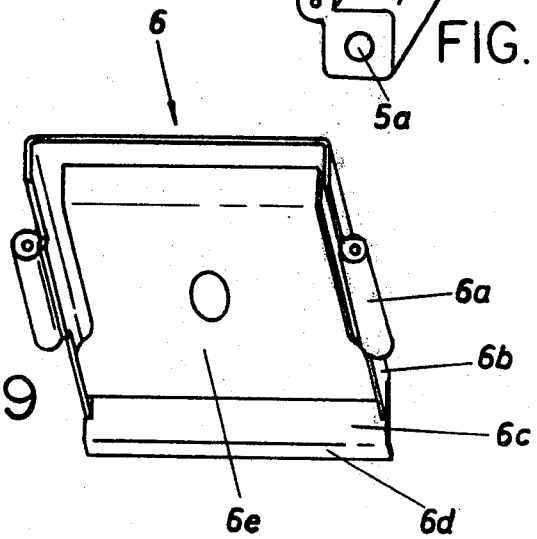

According to the second exemplary embodiment, the construction of the ski brake 1 which forms the subject matter of the present invention is as follows:

FIG. 11 is a side view of an inventive ski brake in the braking position;

FIG. 12 is a perspective view of the erecting spring in the relaxed position;

FIG. 13 is a top view of FIG. 11;

FIG. 14 is a side view of the inventive ski brake in the retracted position;

FIG. 15 is a top view of FIG. 14;

FIG. 16 is a perspective view of the support member;

FIGS. 17 and 18 are a further perspective illustration of a left or a right swivel block; and FIG. 19 is also a perspective view of an operating plate of the inventive ski brake viewed from below.

DETAILED DESCRIPTION

The ski brake 1 has in the first exemplary embodiment a support plate 2, which is secured in a conventional manner on the upper surface 11*a* of a ski 11 by means of screws, only two of which have been schematically indicated, which screws are arranged symmetrically with respect to the longitudinal axis of the ski. In the first exemplary embodiment, the support plate 2 has a rectangular form of uniform thickness. It is designed slightly narrower than the width of the ski 11. The support plate 2 has a pair of pivotal supports 2*a* laterally spaced on opposite sides of the longitudinal center line of the ski and the longitudinal center line of the support plate. In direction of the arrow 11*b* (direction toward the tip of the ski) in front of the two pivotal supports 2*a* there is provided a rectangular-shaped holding loop 2*b* on the support plate 2. The width of the holding loop 2*b* is designed approximately half as wide as the width of the support plate 2. Furthermore the longitudinal axis of the holding loop 2*b* is oriented perpendicular to the longitudinal axis of the ski and symmetrically with respect to same on the support plate 2. An erecting spring 8 is held by the holding loop 2*b* in a manner which will yet be described in more detail.

The ski brake 1 consists substantially of a support member 4, an operating plate 6, two braking legs 10 and an erecting spring which is manufactured of a spring-steel wire.

The erecting spring 8 has in the top view a substantially U-shaped design. In the relaxed position of the erecting spring 8, its two free ends 8*a* define with the plane of the remaining parts an angle $\alpha$. The size of the angle $\alpha$ controls the desired magnitude of the erecting force for the ski brake 1. Larger angles result in larger erecting force or larger initial tension in the retracted position. Furthermore the free ends 8*a* of the erecting spring 8 are in relaxed position at an angle $\beta$ to one another. The free ends 8*a* of the erecting spring 8 are received in the holding loop 2*b*. Furthermore the erecting spring 8 is guided in a manner which will yet be described in more detail on the underside of the operating plate 6.

The operating plate 6 is made of a sheet metal or a different material of uniform thickness and has a rectangular shape. The lateral edges adjacent the ski edges are each bent at 180° and through a certain radius which will yet be described in greater detail hereinbelow and are identified as hinge sections 6*a*. The hinge sections 6*a* are thereby bent in a direction toward the ski 11 away from the remaining parts of the operating plate 6 and extend underneath the top surface thereof. A guide plate 6*f* is provided in the region of the end of the operating plate 6 which faces the tip of the ski, namely, that end which faces in the direction of the arrow 11*b* and on the underside thereof. The longitudinal axis of the guide plate 6*f* is arranged perpendicular to the longitudinal axis of the ski. Its width corresponds with the width of the holding loop 2*b*. The guide plate 6*f* terminates flush with the above-described end of the operating plate 6 and extends in a direction toward the opposite end thereof.

The end of the operating plate 6 remote from the guide plate 6*f* is associated with a support member 4 and has in the region of the hinge sections 6*a* on each side thereof a rectangular-shaped notch 6*h*. The necessity of said notches 6*h* will be described in more detail hereinbelow. Furthermore the end of the operating plate 6 carries in addition two small guide tabs 6*g* of rectangular form and uniform thickness. The small guide tabs 6*g* are arranged such that they terminate in alignment with the end of the operating plate 6 and extend perpendicularly to the plane thereof in direction toward the ski 11. The operating plate 6 has on its upper surface a plastic coating 6*j* which projects beyond its end facing the tip of the ski and at an angle toward the ski 11. The thickness of the plastic coating 6*j* will yet be described in greater detail hereinbelow.

Figure 1A:
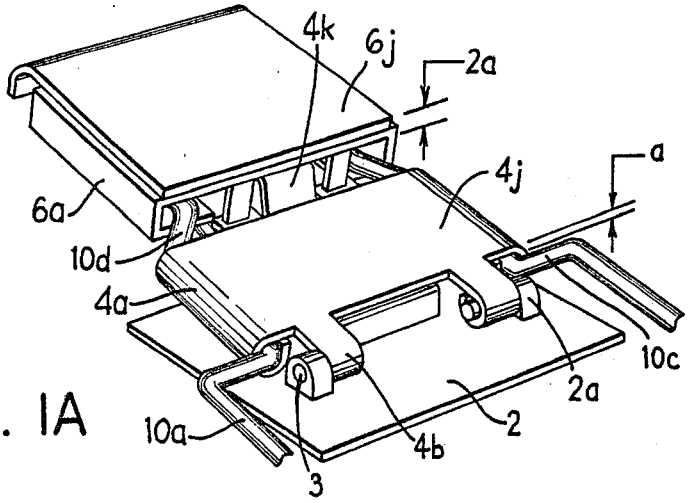
FIG. 1A is a perspective view of the top portion of an inventive ski brake.
Figure 4B:
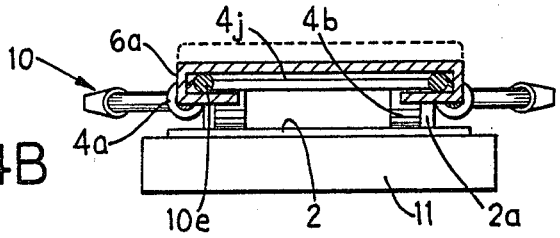
FIG. 4B is a sectional view taken along the line IV-B—IVB of FIG. 1B.
Figure 4C:
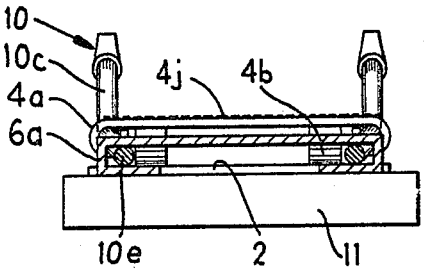
FIG. 4C is a sectional view taken along the line IV-C—IVC of FIG. 4A.
Figure 1B:
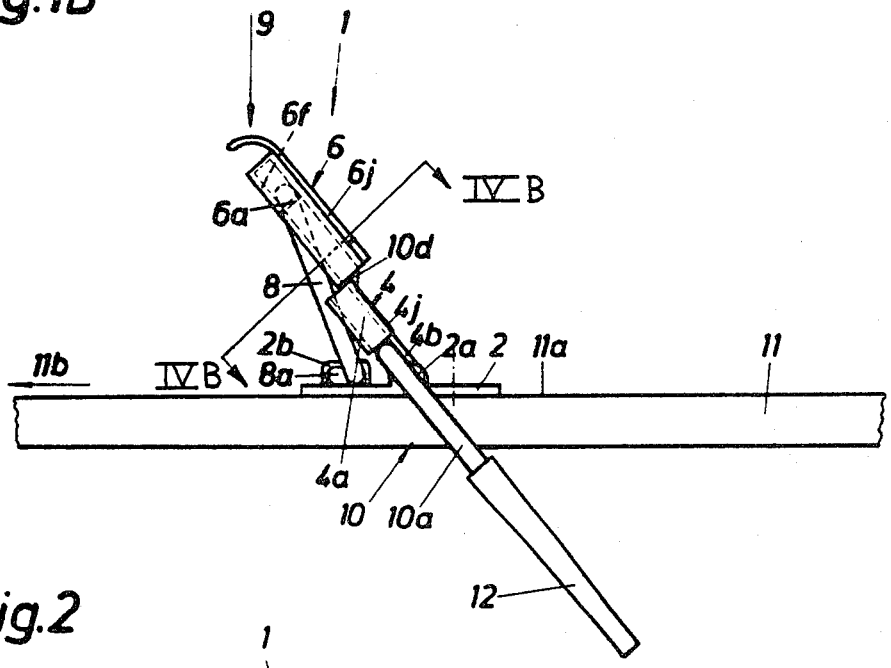
FIG. 1B is a side view of the inventive ski brake in the braking position.
Figure 2:
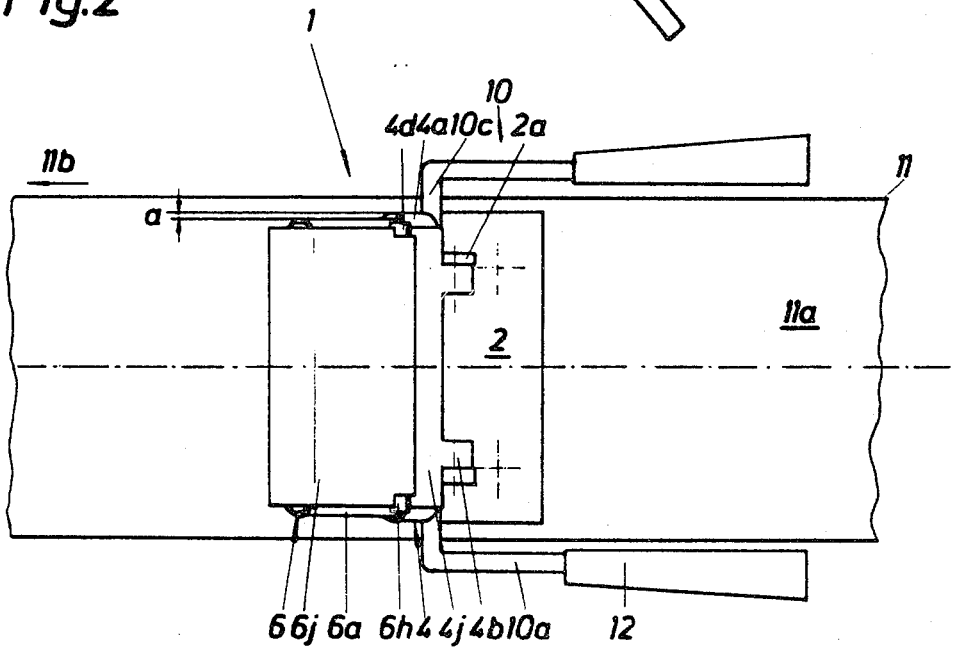
FIG. 2 is a top view of FIG. 1B.
Figure 3:
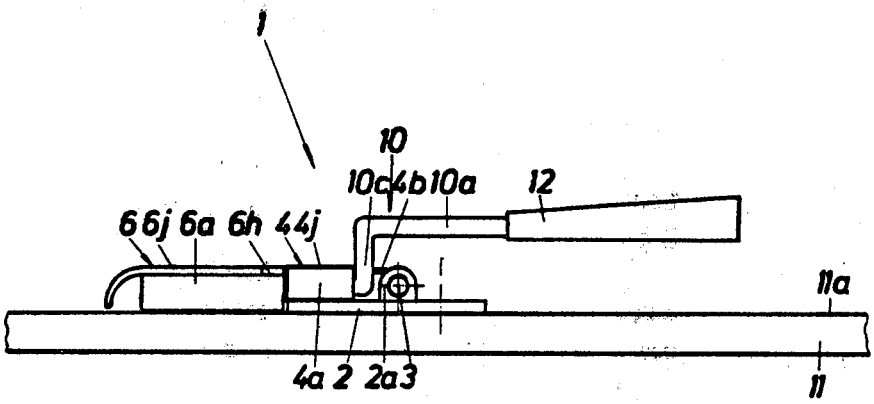
FIG. 3 is a side view of the inventive ski brake in the retracted position.
Figure 4A:
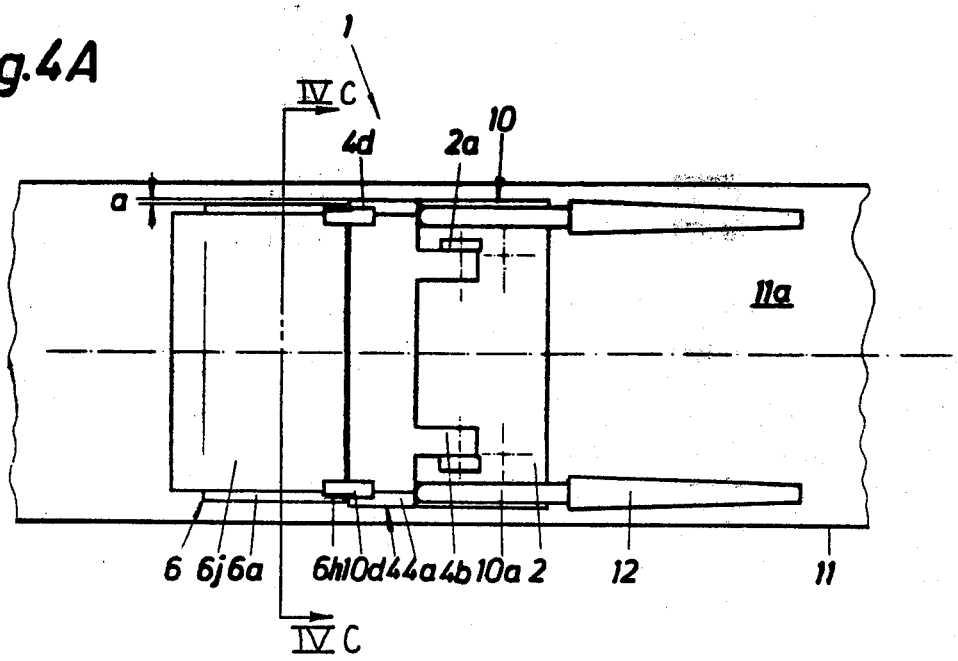
FIG. 4A is a top view of FIG. 3.
Figures 5A, 5B, 6, 7, 8, 9, 10:
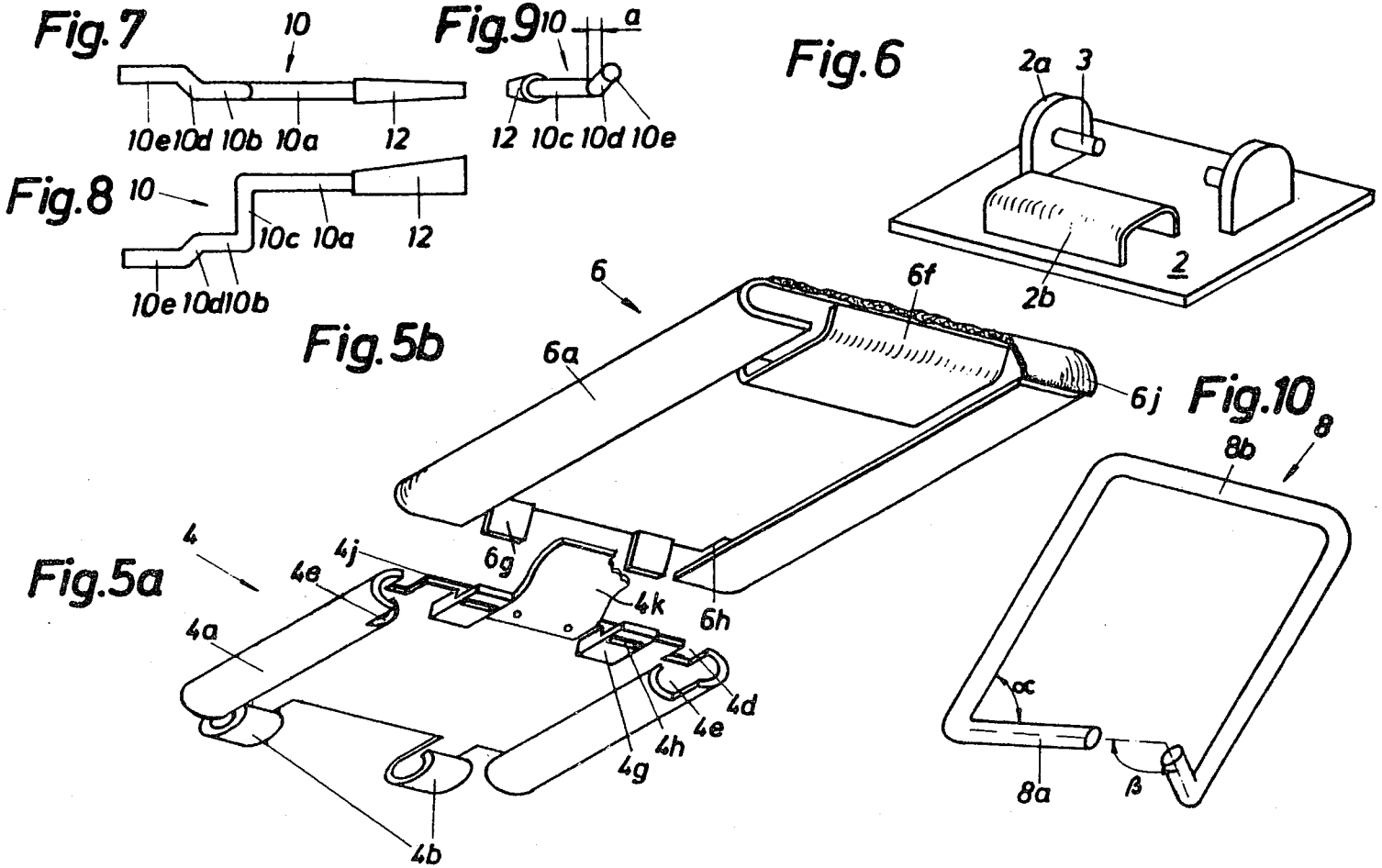
FIGS. 5*a* and 5*b* are an exploded perspective view of a pedal consisting, according to FIG. 5*a*, of a support member and according to FIG. 5*b* of an operating plate.
FIG. 6 is also a perspective view of a support plate.
FIGS. 7 to 9 are side, top and end views, respectively, of a braking wing.
FIG. 10 is a perspective view of an erecting spring.

The small guide tabs 6*g* are symmetrically arranged with respect to the longitudinal axis of the ski and are received in associated guide slots 4*h* provided in guide tongues 4*g* on the support member 4. The guide tongues 4*g* are arranged on the underside of the support member 4 and project forwardly therefrom so that the guide slots 4*h* are exposed. The support member 4 also has a substantially rectangular shape. The lateral edges of the support member 4 are rolled into tubelike bearing structures 4*a* which extend downwardly from the plane thereof in a direction toward the ski 11. The radii or the inside diameter of the tubelike bearing ends 4*a* will be described yet in more detail hereinbelow. The thickness of the flat platelike portion of the support member 4 is of a thickness a which is one half the thickness of the operating plate 6 (FIGS. 1A, 2 and 4A—the purpose of which will be described below). A leaf spring 4*k* is oriented between the guide tongues 4*g* and is secured at one end to support member 4 as shown in FIG. 5*a*. The other end of the leaf spring 4*k* slidingly engages the operating plate 6 and extends between the tabs 6*g*. The securement of the leaf spring to the support member 4 can, if desired, be by rivets not illustrated. The leaf spring 4*k* has an approximate S-shape and serves to resiliently hold the operating plate 6 spaced upwardly from the support plate 4 as shown in FIG. 1B.

The support member 4 also has notches 4*d* opposite the notches 6*h*, the form of which is substantially identical with the notches in the operating plate 6. Furthermore the tubelike wall structures for the bearing ends 4*a* also have notches 4*e*. The notches 4*e* are arranged in those regions of the bearing structures 4*a*, which are below the notches 4*d*. The purpose of providing these notches 4*e* and the notches 4*d* will be described yet in greater detail hereinbelow.

The end of the support member 4 which faces the support plate 2 has two bearing journals 4*b*. Each of these two bearing journals 4*b* encircles an axle pin 3, which is provided on each of the pivotal supports 2*a* on the support plate 2. The axes of the axle pins 3 are positioned approximately perpendicularly to the longitudinal axis of the ski 11. Furthermore the support member 4 is provided on its upper side with a plastic coating 4*j*, the thickness of which will be described hereinbelow and in greater detail.

The tubelike bearing ends 4*a* on the support member 4 serve to receive or pivotally support the braking legs 10 described below. The inside diameter of the bearing ends 4*a* is slightly larger than the diameter of the spring-steel wire which is utilized for the manufacture of the braking legs 10, in order to permit the spring-steel wire to pivot through a limited range.

Each of the two braking legs 10 has a section which functions as a braking arm 10*a*. Each braking arm 10*a* has at its free end a plastic coating thereon forming a blade 12. A first bent segment 10*c* is oriented at a right angle to the braking arm 10*a*. An axle segment 10*b* is oriented at a right angle to the first bent segment 10*c*. With the help of this axle segment 10*b*, the braking leg 10 is supported for pivotal movement through a limited range in the tubelike bearing ends 4*a* on the support member 4. The braking arm 10*a* and the axle segment 10*b* extend parallel with respect to the longitudinal axis of the ski. A second bent segment 10*d* extends in a direction toward the longitudinal center of the ski at an angle of approximately 45° and follows the axle segment 10*b*. Furthermore the second bent segment 10*d* projects at an angle of approximately 45° out of the plane of the remaining part of the braking leg 10 and away in direction from the ski 11 when the aforesaid plane is parallel to the upper surface of the ski. The operating segment 10*e* of the braking leg 10 follows the second bent segment 10*d* and extends parallel with respect to the longitudinal axis of the ski.

Caused by the second bent segment 10*d* extending in a direction toward the center of the ski, the operating segment 10*e* of each braking leg extends at the distance a (FIG. 9) closer to the center of the ski than its axle segment 10*b*. In order to cause the operating segment 10*e* to engage in the retracted position and in the braking position of the ski brake 1 the hinge part 6*a*, a width difference of 2*a* (FIG. 1A) must therefore exist between support member 4 and operating plate 6. The vertical clearance between the parts of the hinge sections 6*a* is thereby also slightly greater than the diameter of the braking legs 10 in the region of the operating segment 10*e*.

The ski brake 1 is held in its braking position by the erecting spring 8. The erecting spring 8 is thereby in its relaxed position. The bight portion thereof is oriented in this position on the end of the guide plate 6*f*, which end is close to the support member 4. The operating plate 6 takes along the support member 4 through the braking legs 10 and holds both structural parts pivoted about the axle pins 3. As can be seen from the drawings of FIGS. 1A, 1B and 2, a vertical height difference exists between the support member 4 and the operating plate 6 caused by the leaf spring 4*k*. That is, the leaf spring 4*k* holds the operating plate in the position shown in FIG. 1B relative to the support member 4. The two braking legs 10 are thereby in a position as it is illustrated in the side view of FIG. 7. To make this position possible, free positions are needed in the support member 4 and in the operating plate 6 for each braking leg 10. For this purpose, the support member 4 is provided with the aforesaid notches 4*d* and the operating plate 6 is provided with the aforesaid notches 6*h*, in both of which are received the second bent segments 10*d*.

If now a force is applied onto the ski brake 1 in direction of the arrow 9 (FIG. 1B), the entire ski brake 1 will pivot about the axle pins 3. First a relative movement against the force of the erecting spring 8 and between the operating plate 6 and the support member 4 will not occur. Only after the support member 4 rests on the support plate 2 and the force is further applied onto the operating plate 6 will the operating plate 6 carry out a movement relative to the support member 4 and approximately in a vertical direction toward the ski 11 and tension the spring 4*k*. Through this movement the braking arms 10*a*, which up to now were pivoted only upwardly about the axle segment 10*c*, are pivoted inwardly above the ski edges through an approximately 90° angle about the axis of the bent segment 10*b*. The tubelike hinge sections 6*a* of the operating plate 6 are oriented approximately enough lower than the tubelike bearing structures 4*a* of the support member 4 to cause the arms 10*a* of the ski brake to extend above the ski in the out of braking position. The second bent segments 10*d* are received in notches 4*e*. Due to the differently thick plastic coatings 4*j*, 6*j* on the support member 4 and the operating plate 6, it is achieved, that the upper surfaces of these two structural parts will lie on the same level in the retracted position.

If the force which acts in direction of the arrow 9 stops to act, both the leaf spring 4*k* and the erecting spring 8 tries to reach its relaxed position as shown in FIG. 1B. The leaf spring 4*k*, which has to overcome only the moment of inertia of the operating plate 6 and the two braking legs 10, more quickly assumes its relaxed condition. Thus, the two braking arms 10*a* are swung out over the lateral edges of the ski. Only subsequently will the erecting spring urge the ski brake 1 about the axle pins 3 in clockwise direction. Thus, it is assured that the braking arms 10*a* will not engage the ski during their movement to the braking position.

ALTERNATE CONSTRUCTION (FIGS. 11 to 19)

In the illustrated second exemplary embodiment, the ski brake 1 has a support plate 2 secured in a conventional manner to the upper surface 11*a* of a ski 11 by means of two schematically illustrated screws arranged symmetrically with respect to the longitudinal axis of the ski. In this embodiment, the support plate 2 has a rectangular shape of uniform thickness. The support plate 2 has in the region of the end which faces the tip of the ski, namely, in the direction of the arrow 11*b*, and on each lateral side thereof, a pivotal support 2*a*. On the longitudinal center line of the support plate extending between the two pivotal supports 2*a* there is provided a holding loop 2*b* having a rectangular cross section. The holding loop 2*b* is arranged such and designed such that it terminates flush at one end thereof with the end of the support plate 2 and at its other end with the two pivotal supports 2*a*. The holding loop 2*b* holds an erecting spring 8 which will be described in greater detail below.

The ski brake 1 consists substantially of a support member 4, two swivel blocks 5, one operating plate 6, two brake legs or brake wings 10 and the aforesaid erecting spring 8 which is manufactured of a spring-steel wire.

The erecting spring 8 has in the top view thereof a substantially U-shaped design. In the relaxed position, its two free ends 8*a* define with the plane of the remaining parts of the erecting spring 8 an angle $\alpha$. The size of the angle $\alpha$ determines the desired magnitude of the erecting force for the ski brake 1. Larger angles result in a larger erecting force or larger initial tension in the retracted position. Furthermore the free ends 8*a* of the erecting spring 8 are positioned in the relaxed position at an angle $\beta$ to one another. The construction of such an erecting spring 8 is known per se. The bight portion 8*b* of the erecting spring 8 is received in the holding loop 2*b* and is held against a lifting off therefrom and at the same time is guided for longitudinal movement therein. Those parts of the erecting spring 8, which form the free ends 8*a*, are connected to the operating plate 6 in a manner which will be described below in greater detail.

The operating plate 6 has a rectangular, approximately cuplike shape which is open in a direction toward the tail of the ski. The operating plate 6 has on each lateral side thereof a hinge section 6*a*. The hinge sections 6*a* are formed on the sidewalls 6*b*, namely they project laterally both in directions toward the ski edges and also in a direction toward the upper surface 11*a* of the ski 11. The hinge sections 6*a* have a circular cross section and are provided with a concentric opening extending in the longitudinal direction which is not delineated in any greater detail.

An end wall 6*c* on the frontwardly facing end of the hinge sections 6*a* of the operating plate 6 projects in a direction toward the ski 11. The free edge of the end wall 6*c* has a 90° bend 6*d* therein extending in a forward direction away from the operating plate 6 and will be described in greater detail.

The swivel blocks 5 which are illustrated in FIGS. 17 and 18 have a rectangular cross section and an opening 5*a* in the region of their central longitudinal axis. Furthermore each swivel block 5 carries in the region of one edge thereof two axially aligned hinge sections 5*b* having a circular cross section, which hinge sections 5*b* each have an opening 5*c* in the region of the longitudinal axes thereof. The hinge sections 5*b* terminate flush with the ends of the swivel block 5. The hinge sections 5*b* are spaced from one another at a distance which is not identified in detail, and which is larger than the length of the hinge section 6*a*, in order to receive same therebetween. The swivel blocks 5 and the operating plate 6 are pivotally connected for movement through a limited range by means of axles 7, which are provided in the openings 5*c* of the hinge sections 5*b* and 6*a*.

The two swivel blocks 5 are mounted on a support member 4 in a manner which will be described in greater detail below. The support member 4 is approximately U-shaped in the top view. The support member 4 is in this case manufactured as a casting as opposed to a metal stamping. Each of the two arms 4*a* of the U-shaped support member 4 is provided with a bearing plate portion 4*b*. With the help of the bearing plate portions 4*b* and through the use of two bearing bolts 3 (FIG. 15), the support member 4 is pivotally supported on the holding plates 2*a*. The two bearing bolts 3 are secured against loss for example by riveting or deforming the end remote from the head into an enlarged head.

Each of the two arms 4*a* has a rectangular recess 4*d* therein. The part of the support member 4 remote from the bearing plate portions 4*b* and constructed as a web or bight portion 4*c*, has on its lower side a recess 4*e*, in which is received the bent free edge 6*d* of the operating plate 6.

Furthermore the support member 4 has on each arm two axially aligned slotted holes 4*f* arranged parallel with respect to the longitudinal axis of the ski 11 and the width elongation extends each transversely with respect to the longitudinal axis of the ski 11.

The recesses 4*d* receive the swivel blocks 5 therein and each of the swivel blocks receive with the help of their openings 5*a* a braking wing 10 therein. The braking wings 10 are rigidly connected to the swivel blocks 5. Furthermore each of the braking wings 10 is rotatably supported in the associated slotted holes 4*f*.

The operating plate 6 will come to lie with its bent edge 6*d* in the recess 4*e* of the support member 4. The erecting spring 8 engages the underside of the operating plate 6. A pivotal separation of the operating plate 6 from the erecting spring 8 is prevented by a holding plate 6*e*, the form of which can be clearly seen in FIG. 19 and which is riveted to the underside of the operating plate 6. The upper end of the downwardly open recess 4*e* of the support member 4 forms a stop for the bent edge 6*d* of the operating plate 6 and prevents an undesired high lifting off of the same from the support member 4. The free ends 8*a* of the erecting spring 8 are arranged between the stepping plate portion and the holding plate 6*e* of the operating plate 6.

If now a force is applied in the direction of the arrow 9 onto the ski brake 1 by a not illustrated ski boot, then said ski brake 1 pivots against the force of the erecting spring 8. If the support member 4 first engages the upper surface 11*a* of the ski 11 and the force which is directed in direction of the arrow 9 continues to act, then the operating plate 6 is moved between the arms 4*a* of the support member 4, until it is flush therewith. The braking mandrels 10*a* of the individual braking wings 10 are rotated approximately 90° in a direction toward the longitudinal center of the ski about the hinge sections 6*a* and 5*b*. Since during a lifting movement of the operating plate 6 the lateral spacing of the hinge sections 6*a* remain always the same, and since those hinge sections 5*b* which are arranged on the swivel block 5 cover during a rotation about the sections of the individual braking wings, which sections serve as axes 10*b* in the support member 4, a path extending in a direction transversely with respect to the longitudinal axis of the ski 11, it is absolutely necessary that this transverse movement be compensated for. This compensation is accomplished by the slotted holes 4*f*. At the start and at the end of the rotational movement of the individual braking wings 10, the wire segments thereof are located at the ends of the slotted hole 4*f* adjacent to the longitudinal axis of the ski. During the rotational movement, the wire segments slide continuously in a direction toward the remote end of the slotted hole 4*f*, which they reach after a rotational movement of approximately 45°. The bight portion 8*b* of the erecting spring 8 will slide during the rotational movement of the ski brake 1 in the holding loop 2*b* in a direction toward the tail of the ski. In the pressed-down end position of the operating plate 6, its upper surface terminates flush with the upper surface of the support member 4.

If the force which acts in the direction of the arrow 9 becomes less or ceases totally from acting, then the erecting spring 8 starts to assume a relaxed position which is illustrated in FIG. 12. The erecting spring 8 activates the ski brake 1 through the operating plate 6. As a result, the operating plate 6 carries out a lifting movement away from the support member 4.

During this lifting movement, each of the braking wings 10 is pivoted outwardly and becomes located outside of the associated lateral edges of the ski. An excessive swinging of the braking wings 10, caused by a lifting of the operating plate 6 too high from the support member 4, is prevented by the bent section 6*b* in cooperation with the upper end of the recess 4*e*. Subsequently the bent section 6*d* carries along the support member 4 and effects a pivoting of the entire ski brake 1 about the bearing axis 4*c*. The ski brake 1 thereby assumes its position illustrated in FIGS. 11 and 13.

Further modifications are conceivable without departing from the scope of the invention.

For example, it is possible to integrate the support plate in a sole plate or the like, or to mount same onto such sole plate. It is also conceivable to connect the support plate by means of a locking mechanism which is not part of the invention with a common safety ski binding. In this case, the ski-fixed arrangement of the support plate is not needed and the braking mechanism can be arranged together with the ski binding on a ski-fixed rail on the ski, along which rail it is movable to compensate for different ski boot sizes. Such an arrangement is preferable in particular for rental skis.

Also the connection of the individual braking legs with the associated swivel block and/or the locking of the individual braking legs in the axial direction relative to the support member can be carried out differently than above described. For example, the braking leg can have a fin and the swivel block a groove (or vice versa). However, it is possible that both parts have a groove, into which is then inserted a small locking plate. An annular groove can be provided on the individual braking legs into which can be inserted a locking ring to prevent an axial shifting. If the slotted holes which are provided in the web of the support member are constructed as blind holes, this locking can be provided in front of or behind the individual swivel blocks. In this case, a greater distance is provided between the swivel block and the adjacent part of the support member than was shown in the drawings of the exemplary embodiment.

Although particular preferred embodiments of the invention have been disclossed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a ski brake having at least one braking leg pivotal by a force applied by a ski boot or by a sole plate secured to a ski boot to a pedal about an axle extending substantially at a right angle with respect to the longitudinal axis of a ski in a mounting member adapted to be secured to said ski, said braking leg being pivotal between a braking position and a retracted position, an erecting spring resisting a pivoting of said braking leg toward said retracted position, said braking leg having a braking mandrel thereon and a first segment therein which extends from said braking mandrel toward the central longitudinal axis of the ski, said braking leg being held totally above the upper surface of said ski and between the lateral edges of said ski in the retracted position of said ski brake by said pedal which is stepped down upon by said ski boot or by said sole plate, and in the braking position of said ski brake, said braking mandrel being positioned laterally outside of one of said ski edges and projecting below the running surface of said ski, said braking leg being pivotal about first means defining a swivel shaft which extends in longitudinal direction of said ski, said first means including at least one further second segment on said braking leg which extends substantially parallel with respect to said central longitudinal axis of said ski brake, and second means operatively connecting said second segment to said axle to facilitate said pivotal movement of said braking leg about the axis of said second segment, the improvement comprising wherein said pedal includes a support member pivotally secured to said mounting member by said axle for movement about said axle, wherein said second means includes bearing means on said support member and having an axis extending generally parallel to said longitudinal axis of said ski when said ski brake is in said retracted position, said second segment being rotatably received in said bearing means, said second means further including laterally offset means on said second segment and extending laterally of said axis, said second means still further including an operating plate operatively connected to said laterally offset means and supported for movement relative to said support member between first and second positions, said first position being elevated above said support member and said second position being flush with said support member, said operating plate effecting a movement of said braking leg to said retracted position in response to a movement of said operating plate from said first position toward said second position thereof and wherein resilient means is provided for continually urging said operating plate to said first position.

2. The ski brake according to claim 1, wherein said resilient means comprises a leaf spring connected to one of said support member and said operating plate and slidingly engages the other of said support member and said operating plate.

3. The ski brake according to claim 2, wherein said support member has a pair of laterally spaced first guide means thereon adjacent said operating plate, and wherein said operating plate has a pair of laterally spaced second guide means thereon guidingly coupled to said first guide means, said leaf spring extending between said pair of first and second guide means.

4. The ski brake according to claim 1, wherein said bearing means comprises a cylindrical sleeve member on said support member.

5. The ski brake according to claim 1, including a pair of braking legs, one each on opposite lateral sides of said ski, wherein said bearing means comprises a pair of laterally spaced cylindrical sleeve members on said support member, each rotatably supporting a second segment therein, and wherein said operating plate is operatively connected to the laterally offset means on each of said second segments.

6. The ski brake according to claim 1, wherein said erecting spring is generally U-shaped having a pair of parallel legs and a bight portion, the two free ends of which being bent inwardly and out of a plane defined by said parallel legs, said mounting member having a recess receiving said free ends therein to orient said legs in a position inclined to the horizontal, said bight portion slidingly engaging said operating plate.

7. The ski brake according to claim 6, wherein said operating plate includes an elongated guide thereon which receives and holds said bight portion of said erecting spring therein.

8. The ski brake according to claim 1, wherein both of said operating plate and said support member have a flat plate with an upwardly facing surface, the thickness of the flat plate on said operating plate is greater than the thickness of the flat plate on said support member, said first segment on said braking leg extending perpendicularly to said upper surface of said ski when both of said flat plates extend generally parallel to said upper surface of said ski but the plane of said flat plate on said operating plate is elevated above the plane of said flat plate on said support member a distance equal to the difference in thickness therebetween, said first segment extending inclined toward the central longitudinal axis of said ski when both of said flat plates are flush with one another.

9. The ski brake according to claim 1, including a pair of braking legs, one each on opposite lateral sides of said ski, and wherein said support member is generally U-shaped having a pair of parallel legs and an interconnecting bight portion, the ends of said legs remote from said bight portion being connected by said axle to said mounting member, said legs each having a longitudinally extending opening therethrough defining said bearing means, each rotatably receiving said second segment of said braking leg therein, each of said legs of said support member having a notch therein, said laterally offset means extending through said notch, said operating plate including hinge means for hingedly connecting said operating plate to each of said laterally offset means, said operating plate occupying the space between said legs on said support member, said operating plate being movable relative to said support member about said hinge means and said bearing means.

10. The ski brake according to claim 9, wherein said operating plate has a holding plate spaced from the underside thereof, and wherein said erecting spring is generally U-shaped having a pair of parallel legs and a bight portion, the two free ends of which being bent inwardly and out of a plane defined by said parallel legs, said mounting member having an elongated recess slidingly receiving said bight portion, said free ends being received between said operating plate and said holding plate to define said resilient means.

11. The ski brake according to claim 10, including stop means for limiting the movement of said operating plate in a direction away from said support member.

12. The ski brake according to claim 11, wherein said stop means includes a bent edge on said operating plate adapted to operatively engage said bight portion of said support member.

13. The ski brake according to claim 9, wherein said openings in said legs of said support member are laterally elongated to facilitate a lateral movement of said second segments therein during a movement of said braking legs between said braking position and said retracted position.

14. The ski brake according to claim 13, wherein said laterally offset means comprises a swivel block fixedly secured to each of said second segments of said braking legs, said swivel blocks each having said hinge means operatively connected thereto, said swivel blocks occupying said notches in said legs of said support member and being pivotal with respect to said support member about the axes of said laterally elongated openings in said legs of said support member.

* * * * *